US009022746B2

(12) United States Patent
Kroupa et al.

(10) Patent No.: US 9,022,746 B2
(45) Date of Patent: May 5, 2015

(54) SHUTTLING BY-PASS COMPRESSOR APPARATUS

(75) Inventors: Kevin Kroupa, St. Louis, MO (US); Stephen Palmer, St. Louis, MO (US)

(73) Assignee: Allied Healthcare Products, Inc., St. Louis, MO (US)

( * ) Notice: Subject to any disclaimer, the term of this patent is extended or adjusted under 35 U.S.C. 154(b) by 739 days.

(21) Appl. No.: 13/229,133

(22) Filed: Sep. 9, 2011

(65) Prior Publication Data

US 2013/0064687 A1 Mar. 14, 2013

(51) Int. Cl.

| | |
|---|---|
| ***F04B 45/04*** | (2006.01) |
| ***F04B 43/02*** | (2006.01) |
| ***F04B 43/04*** | (2006.01) |
| ***F04B 45/047*** | (2006.01) |

(52) U.S. Cl.

CPC ..... *F04B 45/043* (2013.01); *Y10T 29/49236* (2015.01); *F04B 2207/041* (2013.01); *F04B 43/026* (2013.01); *F04B 43/04* (2013.01); *F04B 45/047* (2013.01)

(58) Field of Classification Search

CPC ..... F04B 43/026; F04B 43/04; F04B 45/043; F04B 45/047; F04B 49/08; F04B 49/225; F04B 49/246; F04B 49/035; F04B 2205/03; F04B 2205/04; F04B 2205/05; F04B 2207/041; F04B 2207/042; Y10T 29/49236

USPC ..... 417/413.1, 427, 435, 482, 502, 269, 417/273, 412, 419, 285, 286

See application file for complete search history.

(56) References Cited

U.S. PATENT DOCUMENTS

| | | | | |
|---|---|---|---|---|
| 2,285,215 | A * | 6/1942 | Lotz | 417/234 |
| 3,101,708 | A | 8/1963 | Perry et al. | |
| 3,308,765 | A * | 3/1967 | Mutschler et al. | 417/307 |
| 3,816,030 | A * | 6/1974 | Strauff | 417/299 |
| 4,813,979 | A * | 3/1989 | Miller et al. | 95/96 |
| 4,842,498 | A * | 6/1989 | Bramstedt et al. | 417/571 |
| 5,551,843 | A * | 9/1996 | Hauser | 417/234 |
| 5,968,236 | A * | 10/1999 | Bassine | 96/130 |
| 6,062,256 | A * | 5/2000 | Miller et al. | 137/487.5 |
| 6,126,410 | A * | 10/2000 | Kung et al. | 417/312 |
| 7,686,870 | B1 | 3/2010 | Deane et al. | |
| 2004/0221845 | A1 | 11/2004 | Pranger et al. | |
| 2009/0065007 | A1 | 3/2009 | Wilkinson et al. | |
| 2010/0111715 | A1 * | 5/2010 | DeDecker et al. | 417/62 |

OTHER PUBLICATIONS

Crane Technical Paper 410. 2013 ed. Stamford,CT: Crane, 2013. 4-1 to 4-6, 5-1, 5-5, A-21 to A-23.*

International Search Report and Written Opinion for International Application No. PCT/US2012/049715 dated Oct. 26, 2012.

International Preliminary Report on Patentability, International Application No. PCT/US2012/049715, dated: Mar. 12, 2014.

* cited by examiner

*Primary Examiner* — Devon Kramer
*Assistant Examiner* — Joseph Herrmann
(74) *Attorney, Agent, or Firm* — Polsinelli PC

(57) ABSTRACT

A compressor apparatus having a first compressor head for generating a first gas flow and a second compressor head for generating a second gas flow with a shuttling by-pass component in fluid flow communication between the first and second compressor heads for allowing the output of a portion of either the first gas flow or the second gas flow to be diverted to the other compressor head. The shuttling by-pass component allows a portion of the first gas flow to be diverted from the first compressor head to the second compressor head during an exhaust stroke of the first compressor head, while also allowing a portion of the second gas flow to be diverted from the second compressor head to the first compressor head during an exhaust stroke of the second compressor head in alternating sequence such that a more steady output of gas flow may be attained.

15 Claims, 9 Drawing Sheets

SHUTTLING BY-PASS COMPRESSOR APPARATUS

FIELD

This document relates to a compressor apparatus for providing compressed gas, and in particular to a shuttling by-pass compressor apparatus used with a ventilator system to achieve steady flow rates using less power.

BACKGROUND

In medicine, mechanical ventilation is a method to mechanically assist or replace spontaneous breathing of a patient using a machine called a ventilator. The ventilator may include a prior art compressor apparatus that draws in gas and delivers compressed gas to the patient in a controlled manner to meet patient specifications. As shown in FIG. 1, the prior art compressor apparatus 10 may include a pair of compressor heads 12 and 14 that are synchronized to draw in and force out gas in an alternating fashion such that there is a continuous inflow and outflow of gases from the prior art compressor apparatus 10. In the illustrated embodiment, each of the compressor heads 12 and 14 further includes a respective intake chamber 16A and 16B in selective communication with a respective inlet port 18A and 18B for the entry of gas, such as air, oxygen or a mixture of gases, which then flows into a respective cavity 17A and 17B through a one-way intake valve (not shown). The cavity is configured such that the gas flow from the respective intake chamber 16A and 16B can be compressed and forced from the cavity 17A and 17B of each compressor head 12 and 14 and into an exhaust chamber 20A and 20B through a one-way exhaust valve (not shown), which then allows the compressed gas to exit the compressor heads 12 and 14 through a respective outlet port 22A and 22B. The gas is drawn in, compressed, and forced from the cavity through the exhaust valve by a flexible diaphragm or piston (not shown) driven against the cavity in a reciprocating motion that draws in and forces out the gas flow from the cavity for delivery to the patient at a predetermined flow rate through an output connector 24. Although the prior art high flow compressor apparatus has proven satisfactory for its intended purpose, such a compressor apparatus is unable to provide both a steady flow of a small volume of gas at lower flow rates while also being capable of providing a steady flow of a large volume of gas at higher flow rates. Typically, the prior art compressor apparatus 10 cannot achieve steady state flow of gas at flow rates under 3 liters per minute or the compressor apparatus 10 can stall since the compressor apparatus 10 cannot achieve sufficiently low revolutions per minute by a standard motor used normally for compressor apparatuses 10 that drives each compressor head 12 and 14. In addition, standard compressors are limited in the ratio of minimum flow to maximum flow, which is typically less than 100 to 1. As such, there is a need in the art for a compressor apparatus that permits a steady flow of gases at higher and lower flow rates.

SUMMARY

In one embodiment, a compressor apparatus may include a first compressor head for generating a first gas flow, a second compressor head in fluid flow communication with the first compressor head for generating a second gas flow, and an output connector in fluid flow communication with the first compressor head and the second compressor head for permitting a continuous alternating output of gas flow by the first compressor head and the second compressor head. The compressor apparatus may also include a shuttling by-pass component in fluid flow communication with the first compressor head and the second compressor head for permitting alternating gas flow between the first compressor head and the second compressor head such that a portion of the first gas flow is diverted from the first compressor head to the second compressor head and a portion of the second gas flow is diverted from the second compressor head to the first compressor head in an alternating sequence.

In another embodiment, a method for using a compressor apparatus may include:

providing a compressor apparatus including:

a first compressor head for generating a first gas flow;

a second compressor head in fluid flow communication with the second compressor head for generating a second gas flow;

an output connector in fluid flow communication with the first compressor head and the second compressor head for permitting a continuous alternating output of gas flow by the first compressor head and the second compressor head; and a shuttling by-pass component in fluid flow communication with the first compressor head and the second compressor head for permitting alternating gas flow between the first compressor head and the second compressor head through such that a portion of the first gas flow is diverted from the first compressor head to the second compressor head and a portion of the second gas flow is diverted from the second compressor head to the first compressor head in alternating sequence;

diverting a portion of the first gas flow from the first compressor head to the second compressor head through the shuttling by-pass component; and diverting a portion of the second gas flow from the second compressor head to the first compressor head through the shuttling by-pass component.

In yet another embodiment, a method of manufacturing a compressor apparatus may include:

engaging a first compressor head to a second compressor head with an output connector to permit an output of a first gas flow from the first compressor head and an output of a second gas flow from the second compressor head in an alternating sequence;

engaging a shuttling by-pass component between the first compressor head and the second compressor head for establishing fluid flow communication between the first compressor head and the second compressor head to permit a portion of the outputted first gas to flow from the first compressor head to the second compressor head and a portion of the outputted second gas flow to flow from the second compressor head to the first compressor head in alternating sequence; and operatively engaging a motor with the first compressor head and the second compressor head for driving the first compressor head and the second compressor head in alternating sequence.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures should not be interpreted to limit the scope of the claims.

DETAILED DESCRIPTION

Figure 1:
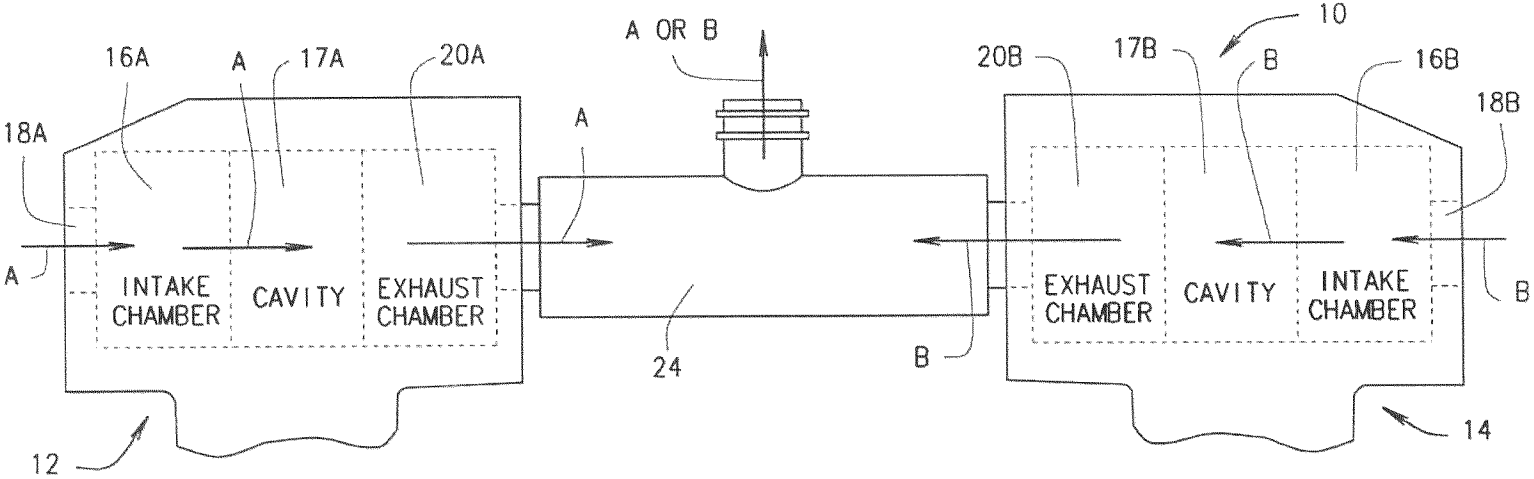
FIG. 1 PRIOR ART
FIG. 1 is a simplified illustration of a prior art compressor head.

As described herein, various embodiments of a compressor apparatus having a shuttling by-pass component is configured such that a portion of each gas flow generated by one compressor head is diverted to the other compressor head, and vice versa, through a shuttle component to achieve an efficient steady output of gas at extremely low flow rates. The result is a minimum to maximum flow ratio that is much greater than standard compressor apparatuses.

Referring to the drawings, various embodiments of the compressor apparatus are illustrated and generally indicated as 100 in FIGS. 2-8. In one embodiment, the compressor apparatus 100 includes a first compressor head 102 and a second compressor head 104 that operate in alternating sequence of intake strokes, wherein gas is drawn into either the first compressor head 102 or second compressor head 104 and alternating sequence of exhaust strokes, wherein gas is exhausted from either the first compressor head 102 or second compressor head 104 in which first and second half cycles of operation represent one full cycle of operation of the compressor apparatus 100. For example, in the first half cycle of operation the first compressor head 102 is in the intake stroke, while the second compressor head 104 is in the exhaust stroke. In the second half cycle of operation the first compressor head 102 is in the exhaust stroke, while the second compressor head 104 is in the intake stroke.

Figure 2A:
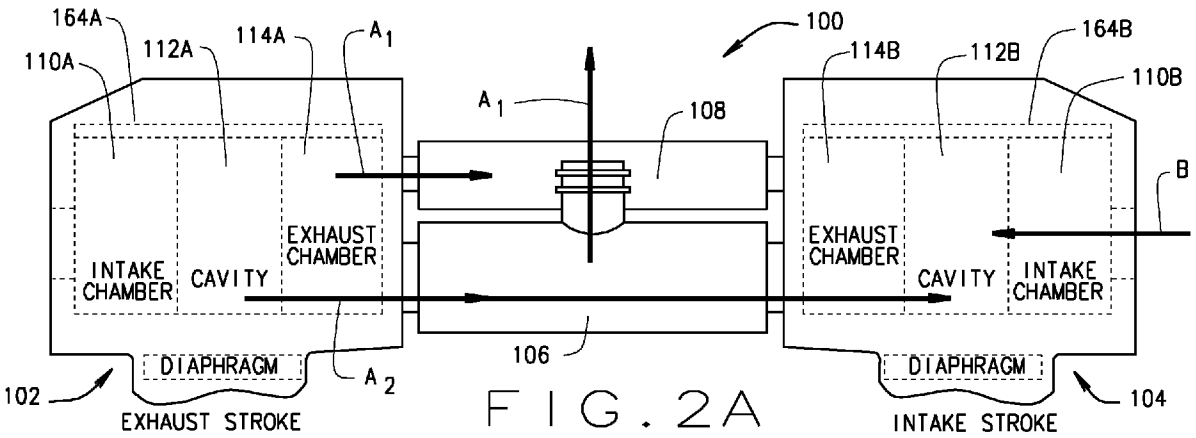
FIG. 2A is a simplified illustration of one embodiment of a compressor apparatus having a shuttling by-pass component illustrating the flow of gas during half of the cycle of operation of the compressor apparatus.
Figure 2B:
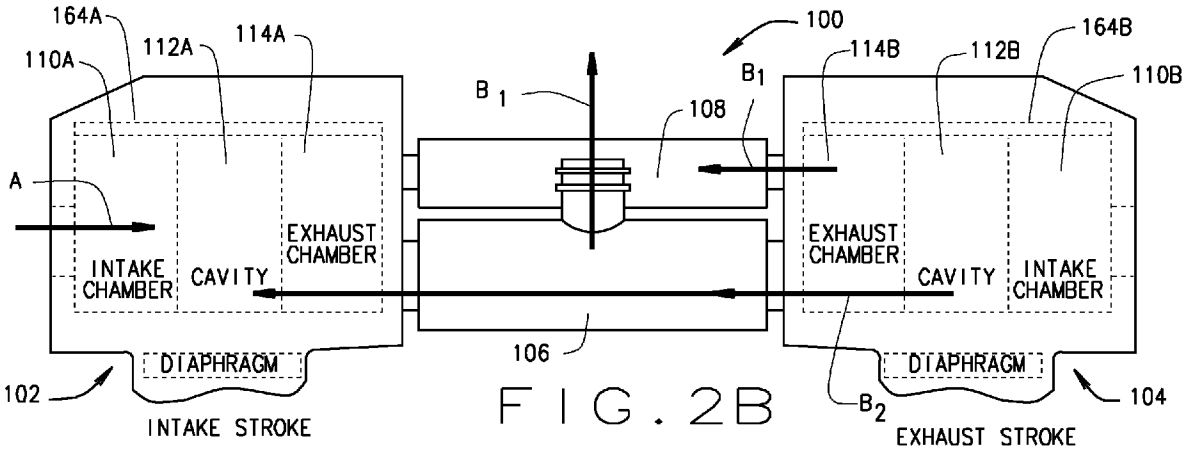
FIG. 2B is a simplified illustration of the compressor apparatus having the shuttling by-pass component illustrating the flow of gas during the other half of the cycle of operation of the compressor apparatus.
Figure 3:
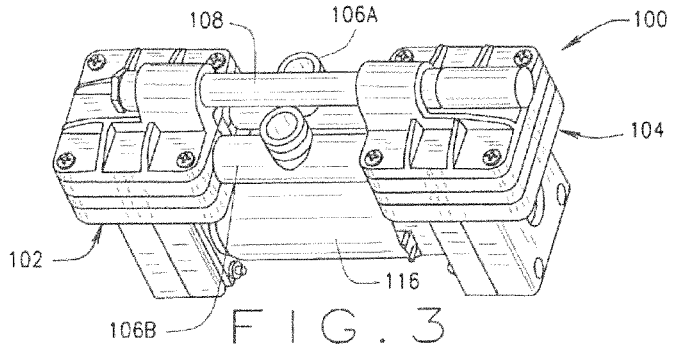
FIG. 3 is an elevated perspective view of the compressor apparatus.
Figure 4:
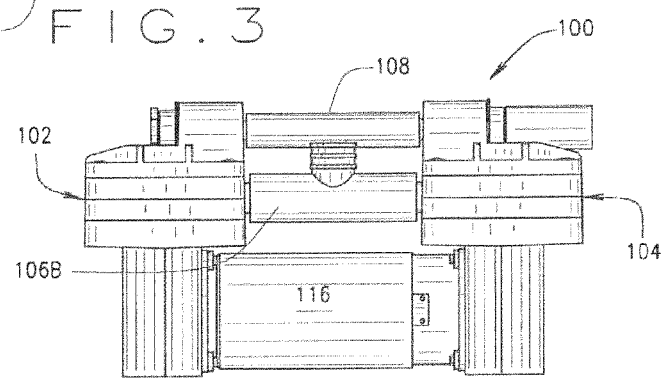
FIG. 4 is a front view of the compressor apparatus.

FIGS. 2A and 2B illustrate this alternating sequence of operation in which FIG. 2A illustrates a first half cycle of operation and FIG. 2B illustrates the second half cycle of operation. As shown in FIG. 2A, during the first half cycle of operation the first compressor head 102 is in the exhaust stroke and exhausts a first gas flow $A_1$, while the second compressor head 104 is in the intake stroke and simultaneously intakes a second gas flow B. Conversely, as shown in FIG. 2B, during the second half cycle of operation the first compressor head 102 is in the intake stroke and intakes gas flow A, while the second compressor head 104 is in the exhaust stroke and simultaneously exhausts gas flow $B_1$. An output connector 106 is in fluid flow communication with the first compressor head 102 and the second compressor head 104 for permitting a continuous alternating exhaust of a portion of gas flow A or B, designated $A_1$ or $B_1$, generated by the first compressor head 102 or the second compressor head 104, respectively. In addition, the compressor apparatus 100 includes a shuttling by-pass component 108 that is in fluid flow communication with the first compressor head 102 and the second compressor head 104 for permitting alternating gas flow directly between the first compressor head 102 and the second compressor head 104 during their respective exhaust strokes such that the a portion of the first gas flow A, designated $A_2$, is diverted from the first compressor head 102 directly to the second compressor head 104, while a portion of the second gas flow B, designated $B_2$, is then diverted from the second compressor head 104 to the first compressor head 102 during the alternating exhaust strokes of the compressor apparatus 100. In one embodiment, the first half cycle of operation for the compressor apparatus 100 requires that diverted gas flow $A_2$ from the first compressor head 102 flow into the second compressor head 104 through the shuttling by-pass component 108 in one direction, which completes the first half cycle of operation, and then diverted gas flow $B_2$ from the second compressor head 104 may flow into the first compressor head 102 in an opposite direction through the shuttling by-pass component 108 during the second half cycle of operation in a continuous alternating sequence of diverted gas flow $A_2$ and $B_2$. Since the first compressor head 102 and the second compressor head 104 exhaust gas flows $A_1$ or $B_1$ from the compressor apparatus 100 in a continuous alternating sequence, the flow of diverted gas flows $A_2$ and $B_2$ between the first compressor head 102 and the second compressor head 104 follows the same alternating sequence of operation. For example, during the first half cycle of operation diverted gas flow $A_2$ is directed from the first compressor head 102 into the second compressor head 104 as the gas flow $A_1$ exits the output connector 106, while gas flow B simultaneously enters the second compressor head 104. Conversely, during the second half cycle of operation the diverted gas flow $B_2$ now flows from the second compressor head 104 into the first compressor head 102 as the gas flow $B_1$ exits the output connector 106, while gas flow A simultaneously enters the first compressor head 102. For example, the compressor apparatus 100 has been shown to achieve minimum steady flow rates as low as 0.2 liters per minute, which is far below flow rates that are normally achieved by the conventional compressor apparatuses 10 without the by-pass component 108 for diverting a portion of gas flow from one compressor head 102 or 104 to the other compressor head 102 or 104. As shall be discussed in greater detail below, comparison tests have been conducted that show that the flow rate ratio of a maximum flow rate to a minimum flow rate is less than 100 to 1 for conventional compressor apparatuses, while a similar test conducted on the compressor apparatus 100 with the shuttling by-pass component 108 have shown a flow rate ratio of 480 to 1 can be achieved. Moreover, in some embodiments, the compressor apparatus 100 can switch the shuttling by-pass component 108 between operational and non-operational states such that an extremely low flow rate can be achieved when the shuttling by-pass component 108 is made operational, while an extremely high flow rate can be achieved when the shuttling by-pass component 108 is made non-operational by the compressor apparatus 100. In such embodiments of the compressor apparatus 100, a flow rate ratio of over 800 to 1 has been achieved.

Figure 7A:
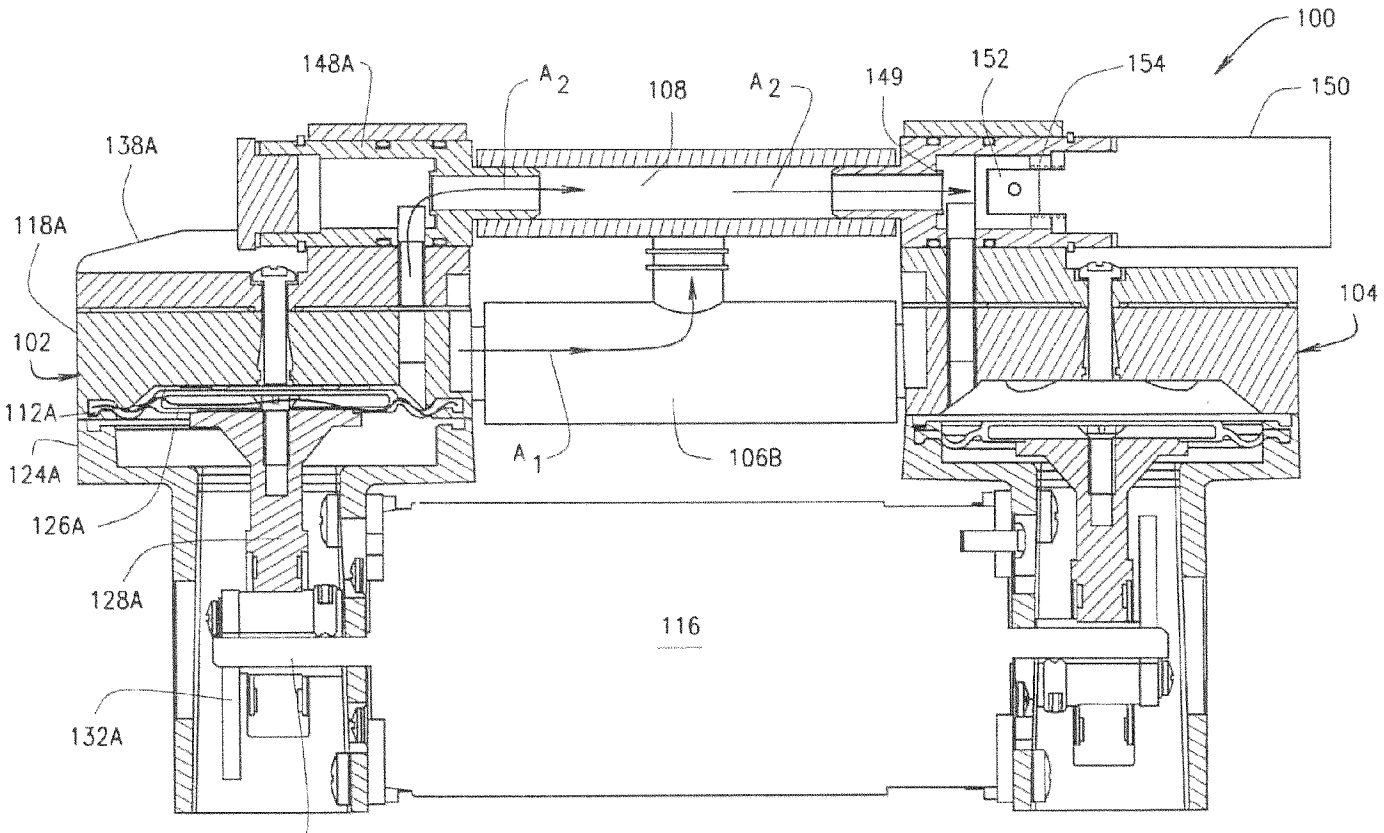
FIGS. 7A and 7B are cross-sectional views taken along line 7-7 of FIG. 6 illustrating the shuttling gas flow between a first compressor head and a second compressor head during different portions of the cycle for the compressor apparatus.
Figure 7B:
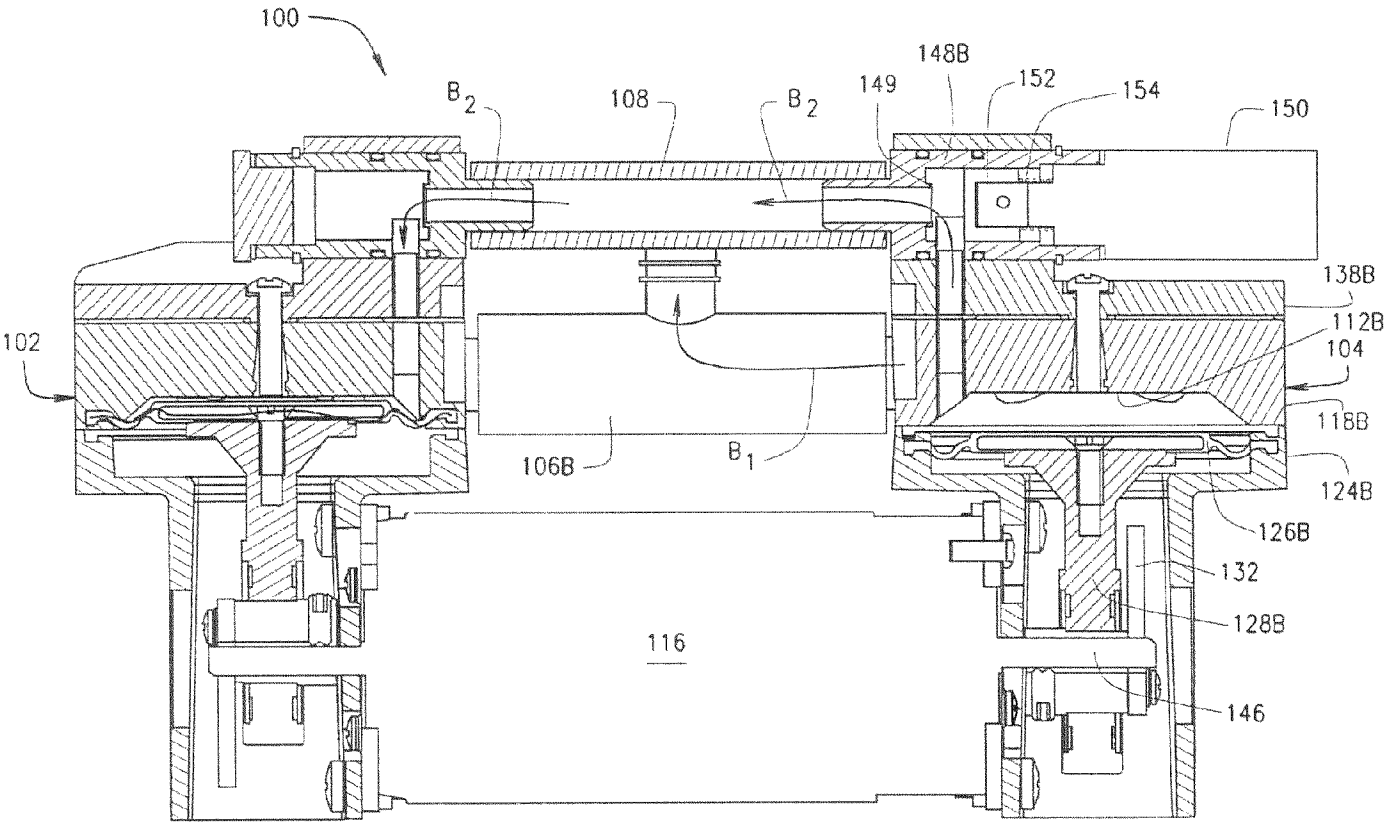

Referring to FIGS. 3-6, one embodiment of the compressor apparatus 100 may include the first compressor head 102 and the second compressor head 104 in fluid flow communication with an intake connector 106 for allowing the entry of gas flows A or B during the respective intake strokes and an output connector 107 gas flows $A_1$ or $B_1$ through the output connector 106B during the respective exhaust strokes for delivery to a patient through a ventilator (not shown). FIGS. 7A and 7B, illustrate the various flow pathways through the compressor apparatus 100 in which the first compressor head 102 and the second compressor head 104 operate in alternating intake and exhaust strokes during completion of a full cycle of operation. In the first half cycle of operation undertaken by the compressor apparatus 100 shown in FIG. 7A, the second compressor head 104 draws in gas flow B into the second compressor head 104 during its respective intake stroke, while the first compressor head 102 simultaneously exhausts out gas flow $A_1$ through the output connector 107 and diverts a portion of gas flow $A_1$, designated gas flow $A_2$, through the shuttling by-pass component 108 to the second compressor head 104 during its respective exhaust stroke. Conversely, during the second half cycle of operation by the compressor apparatus 100 shown in FIG. 7B, the second compressor head 104 exhausts out gas flow B through the output connector 106 during its respective exhaust stroke while simultaneously diverting a portion of gas flow $B_1$, designated gas flow $B_2$, through the shuttling by-pass component 108 in a direction opposite to that taken by the diverted gas flow $A_2$ to the second compressor head 104 as the second compressor head 104 simultaneously draws in gas flow A during its respective intake stroke. As such, the compressor apparatus 100 completes a full cycle of operation when the first compressor head 102 and second compressor head 104 have alternately drawn in respective gas flows A or B and then forced out respective gas flows $A_1$, $A_2$ or $B_1$, $B_2$ in alternating fashion through the shuttling by-pass component 108 or the output connector 107 to complete an intake stroke and an exhaust stroke, respectively.

Figure 8:
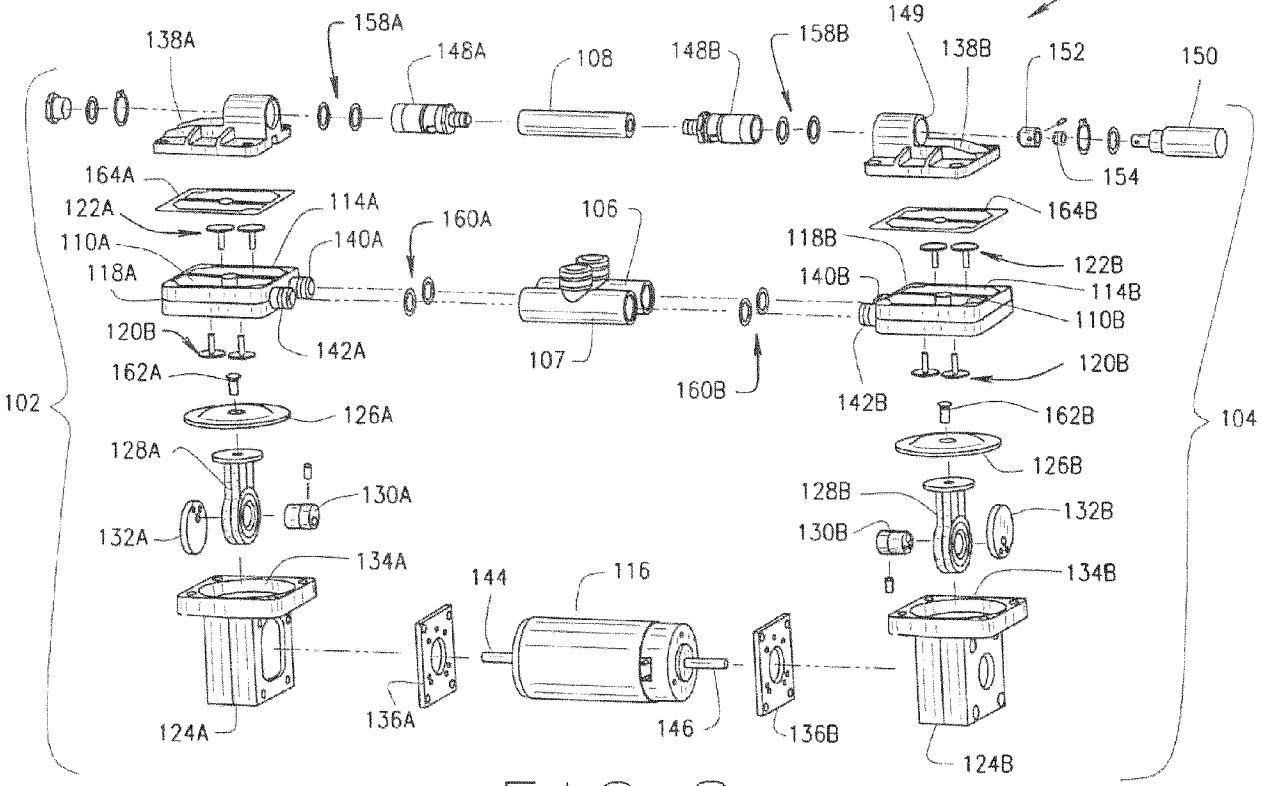
FIG. 8 is an exploded view of the compressor apparatus.

Referring to FIG. 8, the structural elements of the compressor apparatus 100 and their operation will be discussed in greater detail. In one embodiment, the first compressor head 102 is substantially similar in structure and operation as the second compressor head 104 with the exception that the first compressor head 102 operates in alternating sequence relative to the second compressor head 104 to complete a full cycle of operation for the compressor apparatus 100. A motor 116 is provided to operate the first compressor head 102 and the second compressor head 104. In particular, the motor 116 includes a first rotatable shaft 144 for operating the first compressor head 102 and a second rotatable shaft 146 for operating the second compressor head 104.

As shown, the first compressor head 102 includes a pump casing 124A defining a chamber 134A having an arrangement of a connecting rod 128A engaged to an eccentric mass 130A and counterweight 132A disposed therein. The bottom portion of the connecting rod 128A is engaged to the eccentric mass 130A and counterweight 132A, while the top portion of the connecting rod 128A is engaged to a flexible diaphragm 126A through a set screw 162A. Moreover, the bottom portion of the connecting rod 128A is engaged to the rotatable shaft 144 of the motor 116 for moving the connecting rod 128A in an eccentric motion. In operation, the eccentric movement of the connecting rod 128A by the motor 116 moves the diaphragm 126A in a reciprocating motion. An adaptor plate 136A may engage one end of the motor 116 to the pump casing 124A.

In one embodiment, the top portion of the pump casing 124 is engaged to the bottom portion of a compressor head housing 118A, while the top head of the compressor head housing 118A is engaged to a cover head 138A. The compressor head housing 118A includes an inlet 140A that communicates with the intake chamber 110A for permitting the gas flow A to enter therein. The intake chamber 110A is in fluid flow communication with the cavity 112A through a plurality of one-way intake valves 120B that permit the inflow of gas into the cavity 112A from the intake chamber 110A, but prevents retrograde gas flow back into the intake chamber 110A. In addition, the cavity 112A is in fluid flow communication with the exhaust chamber 114A through a plurality of one-way exhaust valves 122A that permit the inflow of gas into the exhaust chamber 114A from the cavity 112A, but prevents retrograde gas flow back into the cavity 112A. The cavity 112A is configured to act in concert with the reciprocating diaphragm 126A such that movement of the diaphragm 126A from the cavity 112A during one-half cycle causes gas flow into the cavity 112A from the intake chamber 110A, while movement of the diaphragm 126A toward the cavity 112A during the other half-cycle causes the gas to become compressed and flow from the cavity 112A and into the exhaust chamber 114A such that the compressed gas exits the outlet connector 107 through the outlet 142A of the compressor head housing 118A.

Similar to the first compressor head 102, the second compressor head 104 includes a pump casing 124B defining a chamber 134B having an arrangement of a connecting rod 128B engaged to an eccentric mass 130B and counterweight 132B disposed therein. The bottom portion of the connecting rod 128B is engaged to the eccentric mass 130B and counterweight 132B, while the top portion of the connecting rod 128B is engaged to a flexible diaphragm 126B through a set screw 162B. Moreover, the bottom portion of the connecting rod 128B is engaged to the rotatable shaft 144 of the motor 116 for moving the connecting rod 128B in an eccentric motion. In operation, the eccentric movement of the connecting rod 128B by the motor 116 moves the diaphragm 126B in a reciprocating motion. An adaptor plate 136B may engage one end of the motor 116 to the pump casing 124B.

In one embodiment, the top portion of the pump casing 124 is engaged to the bottom portion of a compressor head housing 118B, while the top head of the compressor head housing 118B is engaged to a cover head 138A. The compressor head housing 118B includes an inlet 140B that communicates with the intake chamber 110B for permitting the gas flow B to enter therein. The intake chamber 110B is in fluid flow communication with the cavity 112B through a plurality of one-way intake valves 120B that permit the inflow of gas into the cavity 112B from the intake chamber 110B, but prevents retrograde gas flow back into the intake chamber 110B. In addition, the cavity 112B is in fluid flow communication with the exhaust chamber 122B through a plurality of one-way exhaust valves 122B that permit the inflow of gas into the exhaust chamber 114B from the cavity 112B, but prevents retrograde gas flow back into the cavity 112B. The cavity 112B is configured to act in concert with the reciprocating diaphragm 126B such that movement of the diaphragm 126B from the cavity 112B during first half cycle causes gas flow into the cavity 112B from the intake chamber 110B, while movement of the diaphragm 126B toward the cavity 112B during the second half cycle causes the gas to become compressed and flow from the cavity 112B and into the exhaust chamber 114B such that the compressed gas exits the outlet connector 107 through the outlet 142B of the compressor head housing 118B.

As further shown, the shuttling by-pass component 108 may be an elongated hollow shaft that permits two-way gas flow between the first compressor head 102 and the second compressor head 104 when diverted gas flow $A_2$ and diverted gas flow $B_2$ alternately flow between the compressor heads 102 and 104. The shuttling by-pass component 108 defines one end that engages a by-pass fitting 148A for coupling the shuttling by-pass component 108 to the cover head 138A of the first compressor head 102 and an opposite end that engages another by-pass fitting 148B for coupling the shuttling by-pass component 108 to the second compressor head 104. Sealing elements 158A, such as O-rings, provide a fluid-tight seal between the cover head 138A and the by-pass fitting 148A, while sealing elements 158B provide a fluid-tight seal between the cover head 138B and the by-pass fitting 148B. In one embodiment, the by-pass fitting 148B is operatively engaged to a solenoid 150 through a by-pass seat 152 having a spring 154. The spring 154 applies a bias for permitting or preventing fluid flow communication through an orifice 149 formed by the cover head 138B, which is configured to engage the by-pass seat 152 by action of the solenoid 150 which opens and closes the orifice 149 to diverted gas flow $A_2$ or $B_2$. As such, the presence of the shuttling by-pass component 108 allows for the compressor apparatus 100 to achieve extremely lower and steadier flow rates in comparison to the flow rates achievable by the conventional compressor apparatus 10 without the by-pass component 108.

In operation, the solenoid 150 opens the by-pass seat 152 during the exhaust stroke of the first compressor head 102 to permit diverted gas flow $A_2$ to flow from the first compressor head 102 to the second compressor head 104 during first half of cycle of operation. Similarly, the solenoid 150 opens the by-pass seat 152 during the exhaust stroke of the second compressor head 104 to permit diverted gas flow $B_2$ to flow from the second compressor head 104 to the first compressor head 102 during the second half cycle of operation in order to complete a full cycle of operation by the compressor apparatus 100. In some components, the orifice size of the shuttling by-pass component 108 may be tailored to achieve a particular flow rate by the compressor apparatus 100 by diverting a specific amount of diverted gas flow from each of the first and second compressor heads 102 and 104. In other embodiments, the shuttling by-pass component 108 may include a variable orifice (not shown) that provides a variable-sized opening for varying the degree of diverted gas flow $A_2$ or $B_2$ permitted to flow through the shuttling by-pass component 108 to the other compressor head 102 or 104 in order to provide flow adjustment capability. In this manner, the amount of diverted gas flow $A_2$ and $B_2$ may be adjusted for achieving different degrees of low flow rates by the compressor apparatus 100.

In some embodiments, the shuttling by-pass component 108 may be a screw drive or rotary actuator that may be used to open the orifice 149 as a substitute for the solenoid 150.

The advantages of incorporating the shuttling by-pass component 108 into the compressor apparatus 100 is that it lowers the potential steady flow rate attainable by the compressor apparatus 100 by diverting a portion of the gas flow from one compressor head during its exhaust cycle to the other compressor head during its intake cycle, and vice versa, as one full cycle of operation of the compressor apparatus 100 is completed. For example, the compressor apparatus 100 with the shuttling by-pass component 108 can achieve an extremely low flow rate, such as 0.1 liters per minute, when about 97% (based on an 80+ liters per minute of compressor apparatus 100 capacity) of the exhausted gas flow is diverted to the other compressor head and vice versa. This results in a maximum to minimum flow ratio of 800 to 1. The same bypass function may be applied to other compressors with varying capacity to achieve either higher or lower bypass flow rates.

In some embodiments, the shuttling by-pass component 108 may be incorporated into the compressor apparatus 100 having a motor with a fixed power source as an after market modification, which may be used as a means of achieving flow adjustment for the compressor apparatus by varying the amount of gas flow that may be diverted through the shuttling by-pass component 108.

Figure 9:
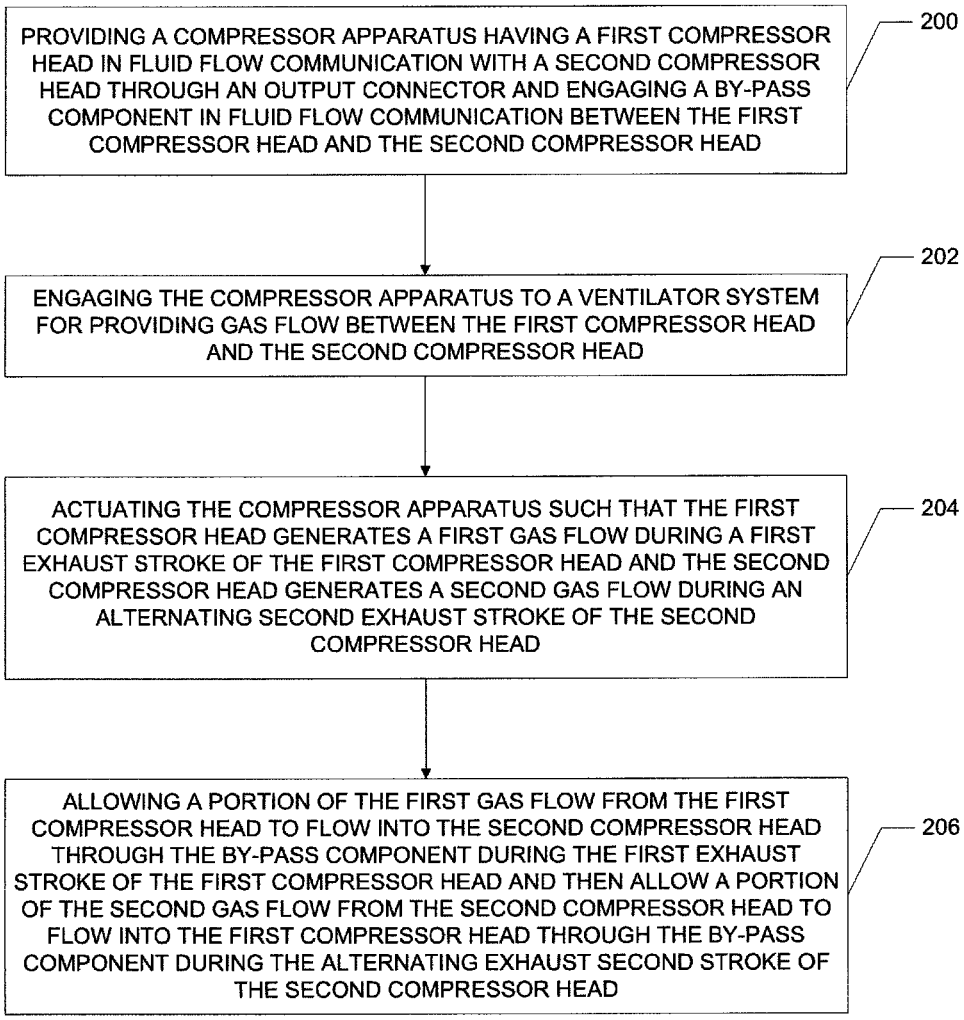
FIG. 9 is a flow chart illustrating the method of using the compressor apparatus.

Referring to FIG. 9, a flow chart illustrates one method of using the compressor apparatus 100. At block 200, a compressor apparatus 100 is provided having a first compressor head 102 in fluid flow communication with a second compressor head 104 through an output connector 106 and then engaging a shuttling by-pass component 108 in fluid flow communication between the first compressor head 102 and the second compressor head 104. At block 202, the compressor apparatus 100 is engaged to a ventilator system for providing gas flow to the first compressor head 102 and the second compressor head 104. At block 204, the compressor apparatus 100 is actuated such that the first compressor head 102 generates a first gas flow during a first exhaust stroke of the first compressor head 102 and the second compressor head 104 generates a second gas flow during an alternating second exhaust stroke of the second compressor head 104. At block 206, a portion of the first gas flow is allowed to flow from the first compressor head 102 and into the second compressor head 104 through the shuttling by-pass component 108 during the first exhaust stroke of the first compressor head 102 and then allowing a portion of the alternating second gas flow from the second compressor head 104 to flow through the shuttling by-pass component 108 and into the first compressor head 102 during an alternating second exhaust stroke of the second compressor head 104.

Figure 10:
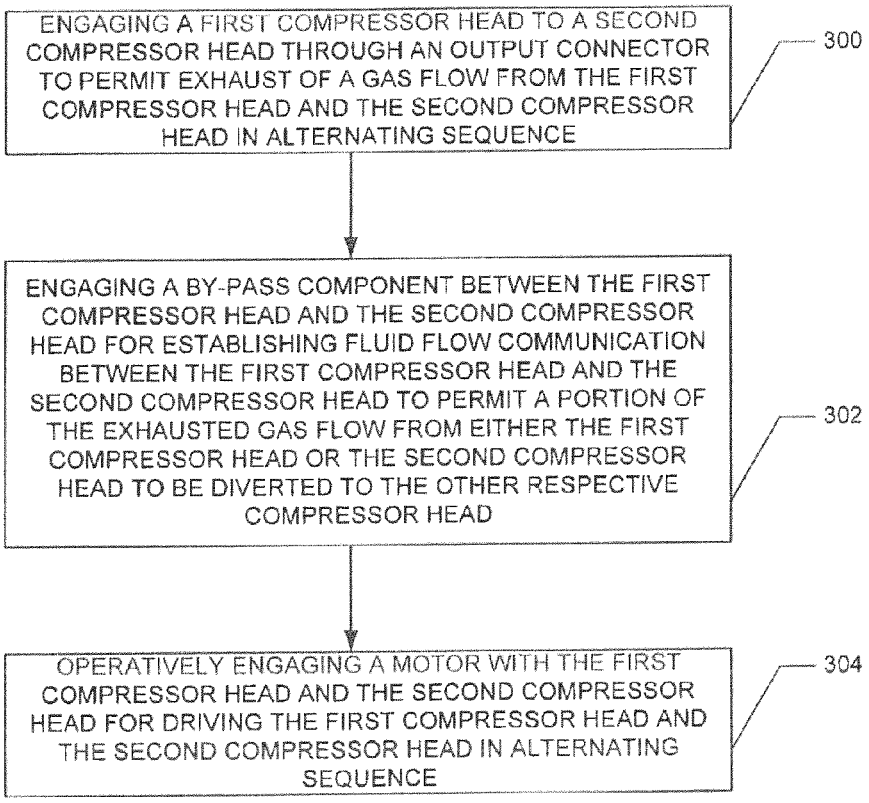
FIG. 10 is a flow chart illustrating the method of manufacturing the compressor head.

Referring to FIG. 10, a flow chart illustrates one method of manufacturing the compressor apparatus 100. At block 300, the first compressor head 102 is engaged to the second compressor head 104 through an output connector 106 to permit exhaust of a gas flow from the first compressor head 102 and the second compressor head 104 in alternating sequence. At block 302, a shuttling by-pass component 108 is engaged between the first compressor head 102 and the second compressor head 104 for establishing fluid flow communication between the first compressor head 102 and the second compressor head 104 to permit a portion of the exhausted gas flow from either the first compressor head 102 or the second compressor head 104 to be diverted to the other respective compressor head 102 or 104. This allows the compressor apparatus 100 to achieve a much lower and steadier flow rate using less power than would otherwise be required by a compressor apparatus 10 without the shuttling by-pass component 108. At block 304, a motor 116 is operatively engaged with the first compressor head 102 and the second compressor head 104 for driving the first compressor head 102 and the second compressor head 104 in alternating sequence.

The compressor apparatus 100 with the shuttling by-pass component 108 may have applications outside the medical field described herein. For example, the compressor apparatus 100 may be used in heating and air conditioning applications as well as refrigeration industries where multi-speed compressors are commonly used.

Test Results

Two different tests were conducted to demonstrate the superior performance of the compressor apparatus 100 with the shuttling by-pass component 108 in comparison with the prior art standard compressor apparatuses 10 without the shuttling by-pass component 108. The first test was directed to comparing minimum/maximum flow rate ratios exhibited by the standard compressor apparatuses 10 relative to the compressor apparatus 100 and the second test was directed to comparing the variance in flow rate between a standard compressor apparatus 10 and the compressor apparatus 100 with the shuttling by-pass component 108. With respect to the first test, tables 1-5 below provide test results that compare the maximum/minimum flow rate ratio achieved by the compressor apparatus 100 with the shuttling by-pass component 108 (Table 5) with the maximum/minimum flow rate ratios achieved by four prior art standard compressor apparatuses 10 without the shuttling by-pass component 108 (Tables 1-4). As shown, table 1 represents a standard compressor apparatus 10 without the shuttling by-pass component 108 manufactured under the product name GAST 15D, which exhibits a minimum flow rate of 0.2 liters per minute at a voltage setting of 2 volts and a maximum flow rate of 17.1 liters per minute at a voltage setting of 12 volts.

TABLE 1

| GAST 15D<br>PUMP WEIGHT: 1.54 LBS | |
|---|---|
| VDC | LPM |
| 0 | 0 |
| 1 | 0 |
| 2 | 0.2 |
| 3 | 0.4 |
| 4 | 1.7 |
| 5 | 4.4 |
| 6 | 6.7 |
| 7 | 8.5 |
| 8 | 10.8 |
| 9 | 12.5 |
| 10 | 13.7 |
| 11 | 15.6 |
| 12 | 17.1 |

TABLE 2

| T SQUARED<br>PUMP WEIGHT: 3.82 LBS | |
|---|---|
| VDC | LPM |
| 0 | 0 |
| 1 | 5.1 |
| 2 | 11.3 |
| 3 | 18.4 |
| 4 | 25.9 |
| 5 | 32.5 |
| 6 | 39.6 |
| 7 | 46.6 |
| 8 | 53.8 |
| 9 | 60.9 |
| 10 | 68.2 |
| 11 | 75.1 |
| 12 | 82.3 |

TABLE 3

| KNF<br>PUMP WEIGHT: 6.64 LBS | |
|---|---|
| POT SETTING<br>VDC | LPM |
| 0 | 0 |
| 1 | 31.1 |
| 2 | 58.7 |

TABLE 3-continued

| KNF<br>PUMP WEIGHT: 6.64 LBS | |
|---|---|
| POT SETTING<br>VDC | LPM |
| 3 | 69.6 |
| 4 | 72.7 |
| 5 | 73.8 |
| 6 | 73.8 |
| 7 | 73.8 |
| 8 | 73.8 |

TABLE 4

| POWEREX<br>ANEST IWATA<br>PUMP WEIGHT: 2.74 LB | |
|---|---|
| VOLTAGE<br>SETTING | LPM |
| 1.7 | 1.3 |
| 1.8 | 5.4 |
| 1.9 | 8.8 |
| 2 | 12.6 |
| 2.2 | 18.9 |
| 2.4 | 24.9 |
| 2.6 | 30.8 |
| 2.8 | 37.2 |
| 3 | 43.3 |
| 3.2 | 49.4 |
| 3.4 | 55.1 |
| 3.6 | 60.7 |
| 3.8 | 66.5 |
| 4 | 71.6 |
| 4.2 | 76.9 |
| 4.4 | 79.3 |
| 4.6 | 79.3 |

TABLE 5

| ALLIED<br>PUMP 1<br>WEIGHT: 4.44 LB | | |
|---|---|---|
| VDC | FULL FLOW<br>LPM | BYPASS<br>FLOW<br>LPM |
| 1 | 3.1 | 0.1 |
| 2 | 10.3 | 0.3 |
| 3 | 17.7 | 0.8 |
| 4 | 22.4 | 5.1 |
| 5 | 33.8 | 10.6 |
| 6 | 40.7 | 13.6 |
| 7 | 45.8 | 18.7 |
| 8 | 55.4 | 24.1 |
| 9 | 63.1 | 31.2 |
| 10 | 69.3 | 37.1 |
| 11 | 76.4 | 43.2 |
| 12 | 83.5 | 48.1 |

Table 2 represents another standard compressor apparatus 10 without the shuttling by-pass component 108 manufactured under the product name T-Squared, which exhibits a minimum flow rate of 5.1 liters per minute at a voltage setting of 1 volt and a maximum flow rate of 82.3 liters per minute at a voltage setting of 12 volts. Table 3 represents another standard compressor apparatus 10 without the shuttling by-pass component 108 manufactured under the product name KNF, which exhibits a minimum flow rate of 31.1 liters per minute at a voltage setting of 1 volt and a maximum flow rate of 73.8 liters per minute at a voltage setting of 8 volts. Table 4 represents yet another standard compressor apparatus 10 without the shuttling by-pass component 108 manufactured under the product name Powerex, which exhibits a minimum flow rate of 1.3 liters per minute at a voltage setting of 1.7 volts. Finally, table 5 represents a compressor apparatus 100 with the shuttling by-pass component 108 manufactured by the Applicants, which exhibits a minimum flow rate of 0.1 liters per minute at a voltage setting of 1 volt and a maximum flow rate of 48.1 liters per minute at a voltage setting of 12 volts when the shuttling by-pass component 108 is made operational, while the compressor apparatus 100 exhibits a minimum flow rate of 3.1 liters per minute at a voltage setting of 1 volt and a maximum flow rate of 83.5 liters per minute when the shuttling by-pass component 108 is made non-operational. As noted above, the compressor apparatus 100 with the shuttling by-pass component 108 can operate to make the shuttling by-pass component 108 operational at times to achieve any extremely low flow rate, while making the shuttling by-pass component 108 non-operational at times to achieve an extremely high flow rate. Table 6 shows the minimum flow rate, maximum flow rate, and the output flow ratios (maximum flow rate/minimum flow rate) for each of the aforementioned compressor apparatuses 10 without the shuttling by-pass component 108 in comparison with the compressor apparatus 100 having the shuttling by-pass component 108.

TABLE 6

| | GAST 15D | T SQUARED | KNF | POWEREX ANEST IWATA | ALLIED |
|---|---|---|---|---|---|
| Compressor Type | Standard | Standard | Standard | Standard | By-Pass |
| Minimum Flow | 0.2 | 5.1 | 31.1 | 1.3 | 0.1 |
| Maximum Flow | 17.1 | 82.3 | 73.8 | 79.3 | 83.5 |
| Output Flow Ratio (Max Flow/ Min Flow) | 85.5 | 16.1 | 2.4 | 61.0 | 835.0 |

Figure 5:
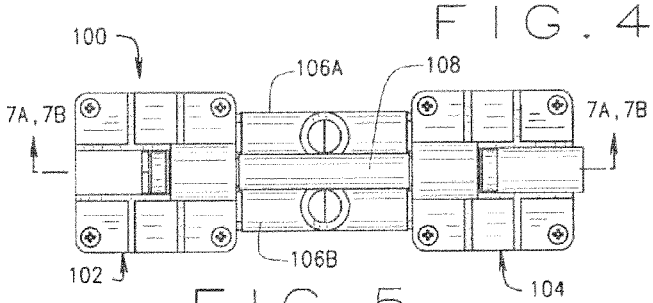
FIG. 5 is a top view of the compressor apparatus.
Figure 6:
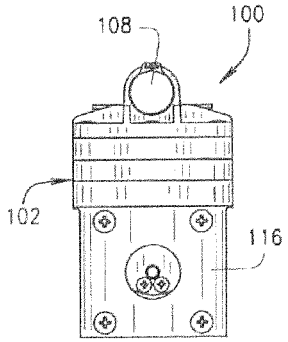
FIG. 6 is a side view of the compressor apparatus.

As shown in table 6, the flow rate ratio of the compressor apparatus 100 with the shuttling by-pass component 108 is almost ten times the flow rate ratio of the closest standard compressor apparatus 10 without the shuttling by-pass component 108. For example, the flow rate ratio of the GAST 15D compressor apparatus 10 without the shuttling by-pass component 108 of table 1 is 85.5 to 1, the flow rate ratio of the T-Squared compressor apparatus 10 without the shuttling by-pass component 108 of table 2 is 16.1 to 1, the flow rate ratio of the KNF compressor apparatus 10 without the shuttling by-pass component 108 of table 3 is 2.4 to 1, and the flow rate ratio of the Powerex compressor apparatus 10 without the shuttling by-pass component 108 of table 4 is 61.0 to 1. In contrast, the flow rate ratio of the compressor apparatus 100 when the shuttling by-pass component 108 is made operational is 481 to 1, while an even higher flow rate ratio of 836 to 1 can be achieved when the compressor apparatus 100 switches the shuttling by-pass component 108 between operational mode to achieve a low flow rate of 0.1 liters per minute and the non-operational mode to achieve a high flow rate of 83.5 liters per minute as illustrated in FIG. 5. The test results clearly show that the compressor apparatus 100 with the shuttling by-pass component 108 has a far greater ratio of maximum flow rate to the minimum flow rate, thereby exhibiting much greater range of flow rates than is achievable by the prior art standard compressor apparatuses 10 without the by-pass component 108 under similar operating conditions. It should be noted that although the voltage settings of the KNF and Powerex compressor apparatuses 10 are between 1-8 volts and 1.7-4.6 volts, respectively, rather than the normal voltage setting range of 1-12 volts used for the other compressor apparatuses 10 and the compressor apparatus 100 during the tests, these smaller voltage setting ranges for the KNF and Powerex compressor apparatuses 10 are due to the smaller operational voltage settings for operating these particular compressor apparatuses 10 at the their equivalent full operational range to obtain both comparable minimum and maximum flow rates.

Figure 11:
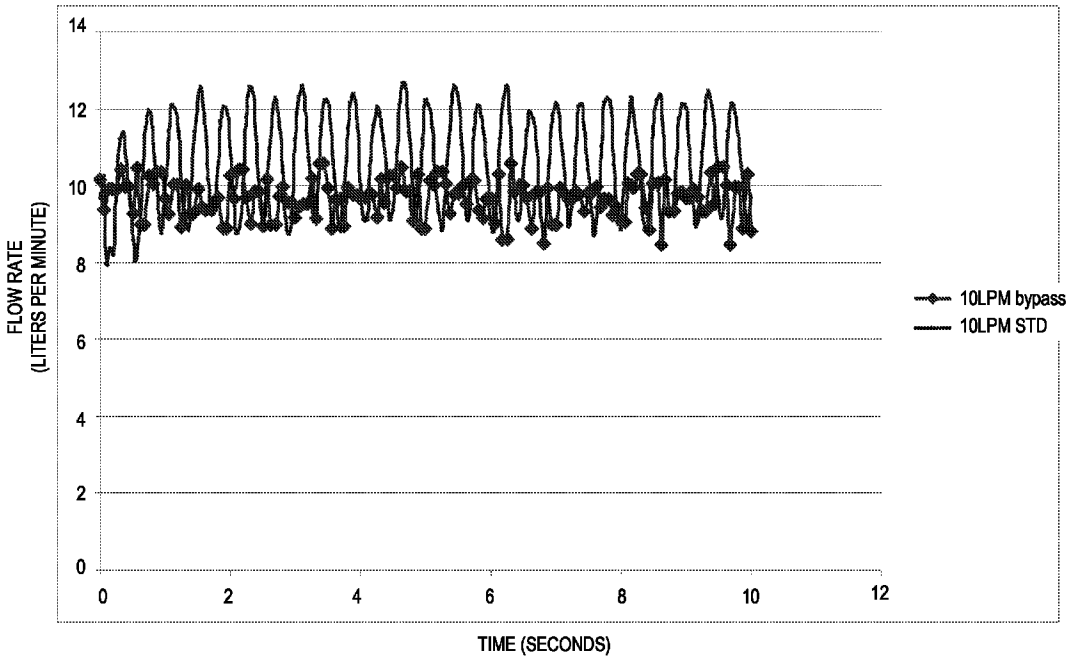
FIG. 11 is a graph illustrating relative performance of the prior art compressor apparatus with the compressor apparatus having the shuttling by-pass component.

Table 7 shows the results of the second test for comparing the variance in flow rate, referred to as pulsations, for a standard compressor apparatus 10 as compared with the compressor apparatus 100 having the shuttling by-pass component 108 at the same flow rate of 10 liters per minute. Minimizing the flow rate pulsations or the variance in flow rate by the compressor apparatus when maintaining a particular flow rate is important since a large variance in flow rate can be felt by a patient connected to a ventilator when the compressor apparatus exhibits a high variance in flow rate when maintaining a particular flow rate. The graph illustrated in FIG. 11 and the test results between the two types of compressor apparatuses 10 and 100 of table 7 clearly show that the compressor apparatus 100 with the shuttling by-pass component 108 demonstrates a much lower variance in flow rate when maintaining a flow rate of 10 liters per minute than the standard compressor apparatus 10 without the shuttling by-pass component 108 when maintaining the same 10 liters per minute flow rate. As shown, the flow rate variance in maintaining a flow rate of 10 liters per minute exhibited by the standard compressor apparatus 10 without the shuttling by-pass component 108 is about 4.7 liters per minute, while the variance in maintaining the same 10 liters per minute flow rate exhibited by the compressor apparatus 100 with the shuttling by-pass component 108 is about 2.0 liters per minute. As such, the standard compressor apparatus 10 without the shuttling by-pass components 108 exhibits a variance in flow rate about 2.5 times larger than the variance in flow rate for the compressor apparatus 100 with the shuttling by-pass component 108. Table 7 showing the test data illustrated in the graph of FIG. 11 is set forth below.

TABLE 7

Date--Time: Wed, Jun 15, 2011--1:58:43 PM
Channel 1

| TIME | LPM STP | TIME | FLOW |
|---|---|---|---|
| 0 | 10.15 | 0 | 9.65 |
| 0.0625 | 9.35 | 0.05 | 10.191 |
| 0.125 | 9.91 | 0.1 | 7.947 |
| 0.1875 | 9.91 | 0.15 | 8.368 |
| 0.25 | 9.88 | 0.2 | 8.225 |
| 0.3125 | 10.41 | 0.25 | 9.831 |
| 0.375 | 9.96 | 0.3 | 11.172 |
| 0.4375 | 9.96 | 0.35 | 11.377 |
| 0.5 | 9.26 | 0.4 | 10.701 |
| 0.5625 | 10.45 | 0.45 | 9.65 |
| 0.625 | 8.97 | 0.5 | 8.599 |
| 0.6875 | 8.97 | 0.55 | 8.008 |
| 0.75 | 10.25 | 0.6 | 8.853 |
| 0.8125 | 10.05 | 0.65 | 10.508 |
| 0.875 | 10.35 | 0.7 | 11.498 |
| 0.9375 | 10.35 | 0.75 | 11.969 |

TABLE 7-continued

Date--Time: Wed, Jun 15, 2011--1:58:43 PM
Channel 1

| TIME | LPM STP | TIME | FLOW |
|---|---|---|---|
| 1 | 9.64 | 0.8 | 11.728 |
| 1.0625 | 9.27 | 0.85 | 10.423 |
| 1.125 | 10.05 | 0.9 | 9.131 |
| 1.1875 | 10.05 | 0.95 | 8.756 |
| 1.25 | 8.91 | 1 | 9.892 |
| 1.3125 | 10.01 | 1.05 | 11.402 |
| 1.375 | 9.26 | 1.1 | 12.09 |
| 1.4375 | 9.26 | 1.15 | 11.981 |
| 1.5 | 9.9 | 1.2 | 11.426 |
| 1.5625 | 9.44 | 1.25 | 10.17 |
| 1.625 | 9.38 | 1.3 | 9.203 |
| 1.6875 | 9.38 | 1.35 | 8.865 |
| 1.75 | 9.54 | 1.4 | 9.928 |
| 1.8125 | 9.69 | 1.45 | 11.365 |
| 1.875 | 8.88 | 1.5 | 12.295 |
| 1.9375 | 8.88 | 1.55 | 12.549 |
| 2 | 10.25 | 1.6 | 11.788 |
| 2.0625 | 9.65 | 1.65 | 10.194 |
| 2.125 | 10.42 | 1.7 | 9.312 |
| 2.1875 | 10.42 | 1.75 | 9.264 |
| 2.25 | 9.7 | 1.8 | 10.459 |
| 2.3125 | 9.02 | 1.85 | 11.679 |
| 2.375 | 9.85 | 1.9 | 12.042 |
| 2.4375 | 9.85 | 1.95 | 11.873 |
| 2.5 | 8.95 | 2 | 11.003 |
| 2.5625 | 10.15 | 2.05 | 9.59 |
| 2.625 | 8.98 | 2.1 | 8.744 |
| 2.6875 | 8.98 | 2.15 | 8.95 |
| 2.75 | 9.73 | 2.2 | 10.266 |
| 2.8125 | 9.96 | 2.25 | 11.776 |
| 2.875 | 9.55 | 2.3 | 12.573 |
| 2.9375 | 9.55 | 2.35 | 12.368 |
| 3 | 9.17 | 2.4 | 11.317 |
| 3.0625 | 9.46 | 2.45 | 9.856 |
| 3.125 | 9.51 | 2.5 | 9.034 |
| 3.1875 | 9.51 | 2.55 | 9.517 |
| 3.25 | 10.2 | 2.6 | 10.943 |
| 3.3125 | 9.13 | 2.65 | 11.981 |
| 3.375 | 10.57 | 2.7 | 12.271 |
| 3.4375 | 10.57 | 2.75 | 11.679 |
| 3.5 | 9.94 | 2.8 | 10.363 |
| 3.5625 | 8.89 | 2.85 | 9.215 |
| 3.625 | 9.65 | 2.9 | 8.72 |
| 3.6875 | 9.65 | 2.95 | 9.602 |
| 3.75 | 8.94 | 3 | 11.172 |
| 3.8125 | 9.95 | 3.05 | 12.295 |
| 3.875 | 9.76 | 3.1 | 12.585 |
| 3.9375 | 9.76 | 3.15 | 12.078 |
| 4 | 9.66 | 3.2 | 10.749 |
| 4.0625 | 9.67 | 3.25 | 9.505 |
| 4.125 | 9.78 | 3.3 | 9.058 |
| 4.1875 | 9.78 | 3.35 | 10.085 |
| 4.25 | 9.18 | 3.4 | 11.522 |
| 4.3125 | 10.18 | 3.45 | 12.223 |
| 4.375 | 9.55 | 3.5 | 12.138 |
| 4.4375 | 10.27 | 3.55 | 11.595 |
| 4.5 | 10.27 | 3.6 | 10.218 |
| 4.5625 | 9.94 | 3.65 | 9.143 |
| 4.625 | 10.48 | 3.7 | 8.817 |
| 4.6875 | 9.84 | 3.75 | 10.013 |
| 4.75 | 9.84 | 3.8 | 11.462 |
| 4.8125 | 9.07 | 3.85 | 12.162 |
| 4.875 | 10.28 | 3.9 | 12.368 |
| 4.9375 | 8.88 | 3.95 | 11.522 |
| 5 | 8.88 | 4 | 10.109 |
| 5.0625 | 10.13 | 4.05 | 9.095 |
| 5.125 | 10 | 4.1 | 9.143 |
| 5.1875 | 10.36 | 4.15 | 10.484 |
| 5.25 | 10.36 | 4.2 | 11.583 |
| 5.3125 | 10.05 | 4.25 | 12.054 |
| 5.375 | 9.27 | 4.3 | 11.836 |
| 5.4375 | 9.78 | 4.35 | 11.184 |
| 5.5 | 9.78 | 4.4 | 10.013 |
| 5.5625 | 9.98 | 4.45 | 9.095 |
| 5.625 | 9.52 | 4.5 | 9.372 |

TABLE 7-continued

Date--Time: Wed, Jun 15, 2011--1:58:43 PM
Channel 1

| TIME | LPM STP | TIME | FLOW |
|---|---|---|---|
| 5.6875 | 10.12 | 4.55 | 10.846 |
| 5.75 | 10.12 | 4.6 | 12.078 |
| 5.8125 | 9.35 | 4.65 | 12.658 |
| 5.875 | 9.15 | 4.7 | 12.67 |
| 5.9375 | 9.64 | 4.75 | 11.365 |
| 6 | 9.64 | 4.8 | 9.976 |
| 6.0625 | 9.01 | 4.85 | 9.131 |
| 6.125 | 10.3 | 4.9 | 9.783 |
| 6.1875 | 8.6 | 4.95 | 11.232 |
| 6.25 | 8.6 | 5 | 12.199 |
| 6.3125 | 10.59 | 5.05 | 12.078 |
| 6.375 | 9.85 | 5.1 | 11.51 |
| 6.4375 | 10 | 5.15 | 10.363 |
| 6.5 | 10 | 5.2 | 9.348 |
| 6.5625 | 9.69 | 5.25 | 8.829 |
| 6.625 | 8.89 | 5.3 | 9.578 |
| 6.6875 | 9.8 | 5.35 | 11.027 |
| 6.75 | 9.8 | 5.4 | 12.283 |
| 6.8125 | 8.49 | 5.45 | 12.609 |
| 6.875 | 9.94 | 5.5 | 12.332 |
| 6.9375 | 8.97 | 5.55 | 11.075 |
| 7 | 8.97 | 5.6 | 9.638 |
| 7.0625 | 9.94 | 5.65 | 9.083 |
| 7.125 | 9.81 | 5.7 | 10.061 |
| 7.1875 | 9.65 | 5.75 | 11.438 |
| 7.25 | 9.65 | 5.8 | 12.078 |
| 7.3125 | 9.84 | 5.85 | 11.788 |
| 7.375 | 9.77 | 5.9 | 11.341 |
| 7.4375 | 9.32 | 5.95 | 10.278 |
| 7.5 | 9.81 | 6 | 9.191 |
| 7.5625 | 9.81 | 6.05 | 8.781 |
| 7.625 | 9.98 | 6.1 | 9.819 |
| 7.6875 | 9.44 | 6.15 | 11.184 |
| 7.75 | 9.64 | 6.2 | 12.271 |
| 7.8125 | 9.64 | 6.25 | 12.597 |
| 7.875 | 9.25 | 6.3 | 11.812 |
| 7.9375 | 9.44 | 6.35 | 10.206 |
| 8 | 9.03 | 6.4 | 9.119 |
| 8.0625 | 9.03 | 6.45 | 9.107 |
| 8.125 | 10.07 | 6.5 | 10.423 |
| 8.1875 | 9.93 | 6.55 | 11.426 |
| 8.25 | 10.29 | 6.6 | 11.909 |
| 8.3125 | 10.29 | 6.65 | 11.764 |
| 8.375 | 9.42 | 6.7 | 11.027 |
| 8.4375 | 8.84 | 6.75 | 9.735 |
| 8.5 | 10.07 | 6.8 | 8.913 |
| 8.5625 | 10.07 | 6.85 | 9.107 |
| 8.625 | 8.48 | 6.9 | 10.496 |
| 8.6875 | 10.15 | 6.95 | 11.836 |
| 8.75 | 9.34 | 7 | 12.15 |
| 8.8125 | 9.34 | 7.05 | 11.933 |
| 8.875 | 9.77 | 7.1 | 10.882 |
| 8.9375 | 9.84 | 7.15 | 9.662 |
| 9 | 9.7 | 7.2 | 8.926 |
| 9.0625 | 9.7 | 7.25 | 9.542 |
| 9.125 | 9.9 | 7.3 | 10.991 |
| 9.1875 | 9.71 | 7.35 | 12.066 |
| 9.25 | 9.34 | 7.4 | 12.102 |
| 9.3125 | 9.34 | 7.45 | 11.45 |
| 9.375 | 10.33 | 7.5 | 10.411 |
| 9.4375 | 9.52 | 7.55 | 9.312 |
| 9.5 | 10.49 | 7.6 | 8.684 |
| 9.5625 | 10.49 | 7.65 | 9.445 |
| 9.625 | 10.01 | 7.7 | 11.015 |
| 9.6875 | 8.48 | 7.75 | 12.15 |
| 9.75 | 9.96 | 7.8 | 12.259 |
| 9.8125 | 9.96 | 7.85 | 12.005 |
| 9.875 | 8.89 | 7.9 | 10.556 |
| 9.9375 | 10.3 | 7.95 | 9.312 |
| 10 | 8.83 | 8 | 8.865 |

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A compressor apparatus comprising:

a first compressor comprising a first compressor head having an exhaust chamber and a cavity, the first compressor head for generating a first gas flow;

a second compressor comprising a second compressor head having an exhaust chamber and a cavity in fluid flow communication with the first compressor head, the second compressor head for generating a second gas flow;

an output connector in fluid flow communication with the first compressor head and the second compressor head for permitting a continuous alternating output of the first gas flow and the second gas flow by the first compressor head and the second compressor head, respectively;

a shuttling by-pass component comprising a by-pass connector in fluid flow communication between the exhaust chamber of the first compressor head and the exhaust chamber of the second compressor head;

the shuttling by-pass component for permitting continuous alternating gas flow between the first compressor head and the second compressor head;

the shuttling by-pass component and the by-pass connector are such that a portion of the first gas flow is diverted from the exhaust chamber of the first compressor head to the cavity of the second compressor head and a portion of the second gas flow is then diverted from the exhaust chamber of the second compressor head to the cavity of the first compressor head in a continuous alternating sequence by activation of the by-pass connector;

wherein the first compressor head has a first intake stroke to draw in the first gas flow and an alternating first exhaust stroke to output the first gas flow and the second compressor head has a second intake stroke to draw in the second gas flow and an alternating second exhaust stroke to output the second gas flow; and wherein the first compressor and second compressor are such that when the first compressor head is in the first intake stroke the second compressor head is simultaneously in the second exhaust stroke and when the first compressor head is in the first exhaust stroke the second compressor head is simultaneously in the second intake stroke.

2. The compressor apparatus of claim 1, wherein the shuttling by-pass component includes, a first by-pass orifice at a first end and a second by-pass orifice at the opposite end, for permitting either the diverted first gas flow through the first by-pass orifice or the diverted second gas flow through the second by-pass orifice when the by-pass connector is in an open position.

3. The compressor apparatus of claim 2, wherein the by-pass connector is a solenoid having a spring-loaded seat that permits or prevents gas flow of either the diverted first gas flow or the diverted second gas flow through the shuttling by-pass component.

4. The compressor apparatus of claim 1, wherein the first compressor head and the second compressor head each comprise:

an inlet port in fluid flow communication with an intake chamber for allowing the entry of the gas flow therein;

at least one intake valve in communication with the intake chamber and the cavity for permitting the gas flow to flow from the intake chamber and into the cavity during the respective first and second intake strokes;

at least one exhaust valve in communication with the cavity and the exhaust chamber for permitting the gas flow to flow from the cavity and into the exhaust chamber during the respective first and second exhaust strokes;

a flexible diaphragm configured to be driven against a wall of the cavity in a reciprocating motion for drawing in the gas flow into the cavity in one motion of the flexible diaphragm during the respective first or second intake strokes and forcing gas out of the cavity in an opposite motion of the flexible diaphragm during the respective first and second exhaust strokes; and an outlet port in fluid flow communication with the exhaust chamber for permitting the gas flow to exit from the exhaust chamber during the respective first and second exhaust strokes.

5. The compressor apparatus of claim 1, wherein the compressor apparatus achieves a minimum flow rate of about 0.1 liters per minute.

6. The compressor apparatus of claim 1, wherein a flow rate ratio of a maximum flow rate to a minimum flow rate for the compressor apparatus is over 800 to 1.

7. The compressor apparatus of claim 1, wherein when the first compressor head and the second compressor head operate such that the first compressor head is in the exhaust stroke the portion of the first gas flow is diverted from the exhaust chamber of the first compressor head to the cavity of the second compressor head through the by-pass connector of the shuttling by-pass component and when the second compressor head is in the exhaust stroke the portion of the second gas flow is diverted from the exhaust chamber of the second compressor head to the cavity of the first compressor head through by-pass connector of the shuttling by-pass component.

8. The compressor apparatus of claim 1, further comprising:

at least one motor in operative engagement with the first compressor head and the second compressor head for driving the diaphragm in the reciprocating motion.

9. A method for using a compressor apparatus comprising:

providing a compressor apparatus comprising:

a first compressor having a first compressor head having an exhaust chamber and a cavity for generating a first gas flow;

a second compressor having a second compressor head having an exhaust chamber and a cavity in fluid flow communication with the first compressor head for generating a second gas flow;

an output connector in fluid flow communication with the first compressor head and the second compressor head for permitting a continuous alternating output of gas flow by the first compressor head and the second compressor head; and a shuttling by-pass component comprising a by-pass connector in fluid flow communication with the exhaust chamber of the first compressor head and the exhaust chamber of the second compressor head for permitting continuous alternating gas flow between the first compressor head and the second compressor head through the by-pass connector of the shuttling by-pass component such that a portion of the first gas flow is diverted from the exhaust chamber of the first compressor head to the cavity of the second compressor head and a portion of the second gas flow is diverted from the exhaust chamber of the second compressor head to the cavity of the first compressor head in a continuous alternating sequence;

diverting the portion of the first gas flow from an exhaust chamber of the first compressor head to a cavity in the second compressor head through the shuttling by-pass component; and diverting the portion of the second gas flow from an exhaust chamber of the second compressor head to a cavity in the first compressor head through the shuttling by-pass component in a continuous alternating sequence with diverting said portion of the first gas flow from the exhaust chamber of the first compressor head to the cavity of the second compressor head.

10. The method of claim 9, wherein diverting the portion of the first gas flow from the first compressor head to the second compressor head continuously alternates with diverting the portion of the second gas flow from the second compressor head to the first compressor head allows for the operation of the compressor apparatus at less than full potential capacity of both the first compressor head and the second compressor head, respectively.

11. A method of manufacturing a compressor apparatus comprising:

engaging a first compressor having a first compressor head comprising an exhaust chamber and a cavity to a second compressor having a second compressor head comprising an exhaust chamber and a cavity with an output connector to permit an output of a first gas flow from the first compressor head and an output of a second gas flow from the second compressor head in a continuous alternating sequence;

engaging a rotating by-pass component in fluid flow communication between the exhaust chamber of the first compressor head and exhaust chamber of the second compressor head to permit a portion of the outputted first gas flow to flow from the exhaust chamber of the first compressor head to the cavity of the second compressor head through the rotating by-pass component and a portion of the outputted second gas flow to flow from the exhaust chamber of the second compressor head to the cavity of the first compressor head through the rotating by-pass component in a continuous alternating sequence; and operatively engaging a motor with the first compressor head and the second compressor head for driving the first compressor and the second compressor in a continuous alternating sequence.

12. The method of claim 11, wherein the output connector is a first output connector for outputting the first gas flow from the first compressor head and a second output connector for alternatively outputting the second gas flow from the second compressor head.

13. The method of claim 11, wherein the first compressor head further comprises a first diaphragm for generating the first gas flow during an intake stroke of the first compressor head and the second compressor head further comprises a second diaphragm for generating the second gas flow during an intake stroke of the second compressor head.

14. The method of claim 13, wherein the first diaphragm causes a portion of the first gas flow to be diverted through the rotating by-pass component to the second compressor head during an exhaust stroke of the first compressor head and wherein the second diaphragm causes a portion of the second gas flow to be diverted through the rotating by-pass component to the first compressor head during an exhaust stroke of the second compressor head.

15. The method of claim 11, wherein the rotating by-pass component includes a first by-pass orifice at a first end and a second by-pass orifice at a second end thereof for permitting the flow of either the diverted first gas flow or the diverted second gas flow through the rotating by-pass component when a one of the first and second by pass orifices is in the open position and preventing the flow of either the diverted first gas flow or the diverted second gas flow when the one of the first and second by-pass orifice is in the closed position.

* * * * *